US007395804B2

(12) United States Patent
Takemoto et al.

(10) Patent No.: US 7,395,804 B2
(45) Date of Patent: Jul. 8, 2008

(54) LUBRICATION STRUCTURE OF ENGINE

(75) Inventors: Kazuhisa Takemoto, Saitama (JP); Tomio Onozato, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/785,847

(22) Filed: Apr. 20, 2007

(65) Prior Publication Data

US 2007/0246000 A1 Oct. 25, 2007

(30) Foreign Application Priority Data

Apr. 25, 2006 (JP) ..... 2006-120691

(51) Int. Cl.
*F01M 1/02* (2006.01)
*F01M 1/12* (2006.01)

(52) U.S. Cl. ..... 123/196 R; 184/6.13

(58) Field of Classification Search ..... 123/196 R, 123/196 CP; 184/6.5, 6.13
See application file for complete search history.

(56) References Cited

U.S. PATENT DOCUMENTS 3,523,592 A 8/1970 Fenton
6,457,449 B1 10/2002 Troxler et al.

FOREIGN PATENT DOCUMENTS

FR 2783278 A1 3/2000
JP 2005-61387 A 3/2005

*Primary Examiner*—Noah P. Kamen
(74) *Attorney, Agent, or Firm*—Birch, Stewart, Kolasch & Birch, LLP

(57) ABSTRACT

The lubrication structure of an engine is provided with a crankcase having a crank chamber that houses a crankshaft. A first oil reservoir is in communication with the crank chamber and is formed adjacent a bottom of the crank chamber. A second oil reservoir is in communication with the first oil reservoir and is formed adjacent the side of and on the bottom of the first oil reservoir. A reed valve extends diagonally from the bottom of the first oil reservoir toward the top of the second oil reservoir in an opening where the first oil reservoir and the second oil reservoir communicate with the crankcase. The reed valve includes a valve element that opens and closes according to the variation of pressure in the crank chamber. The valve element of the reed valve is arranged on the side of the second oil reservoir.

18 Claims, 6 Drawing Sheets

LUBRICATION STRUCTURE OF ENGINE

CROSS-REFERENCE TO RELATED APPLICATIONS

This nonprovisional application claims priority under 35 U.S.C. § 119(a) on Patent Application No. 2006-120691, filed in Japan on Apr. 25, 2006, the entirety of which is incorporated herein by reference.

BACKGROUND OF THE INVENTION

1. Field of the Invention

The present invention relates to a lubrication structure of an engine that is suitable for a motorcycle, particularly a motorcycle that is used for off-road driving sports.

2. Background of the Invention

As an agitation loss is caused due to a crankshaft and other things when a motorcycle is run in a state in which lubricating oil accumulates in a crankcase of an engine, a reed valve is provided between a crank chamber and an oil pan to prevent the lubricating oil exhausted into the oil pan from the crank chamber from flowing in a reverse direction into the crank chamber. The reed valve is arranged vertically, that is, so that a valve element is open in a lateral direction of the body (see JP-A No. 2005-61387, for example).

However, the lubricating oil exhausted from the crank chamber flows laterally when the reed valve is vertically arranged and the valve element is formed so that it is open in the lateral direction of the body. Therefore, the lubricating oil is apt to stay in a space before and after the reed valve and an efficiency problem occurs, wherein the lubricating oil is not exhausted from the crank chamber sufficiently. On the other hand, a larger space is required for the lubricating oil exhausted from the reed valve on the downstream side of the engine when the reed valve is arranged horizontally so that the valve element of the reed valve is open downward. Therefore, the entire height of the engine is increased as a result and a problem occurs in that it is hard to secure a minimum road clearance (a distance from the ground to the lowest end of the engine).

SUMMARY OF THE INVENTION

The present invention is made in view of such problems, and an object of the present invention is to provide the lubrication structure of an engine an increase of an entire height that is inhibited by diagonally extending a reed valve.

To address these problems, the lubrication structure of the engine according to the present invention is provided with: a crankcase having a crank chamber that houses a crankshaft, having a first oil reservoir in communication with the crank chamber and formed adjacent a bottom of the crank chamber, having a second oil reservoir in communication with the first oil reservoir and formed adjacent a side of and on a bottom of the first oil reservoir, and having a third oil reservoir in communication with the second oil reservoir and formed adjacent a bottom of the second oil reservoir; and a reed valve extending diagonally from the bottom of the first oil reservoir toward the top of the second oil reservoir in a part where the first oil reservoir and the second oil reservoir communicate (for example, the opening 54 in this embodiment) of the crankcase and having a valve element that opens and closes according to the variation of pressure in the crank chamber. The valve element of the reed valve is arranged on the side of the second oil reservoir.

As for the lubrication structure of the engine according to the present invention described above, it is desirable that a part where the crank chamber and the first oil reservoir communicate and the valve element of the reed valve are arranged side by side in a tangential direction of the rotational locus of the crankshaft in a side view.

In addition, it is desirable that a wall forming the crank chamber and a wall forming the first oil reservoir are continuously formed and the valve element is arranged on an extended line of these walls.

The flow of lubricating oil that flows out of the crank chamber is smoothed and the lubricating oil hardly stays in a space before and after the reed valve (in the first oil reservoir and the second oil reservoir) when the lubrication structure of the engine according to the invention is configured as described above. Therefore, the lubricating oil in the crank chamber is promptly exhausted and the agitation loss of the lubricating oil due to the crankshaft and other things can be reduced. In addition, the increase of the entire height of the engine provided with the lubrication structure is inhibited by diagonally arranging the reed valve, the engine can be compacted, and an oil pan (the third oil reservoir) can be arranged on the downside of the reed valve in a state in which minimum road clearance is secured.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
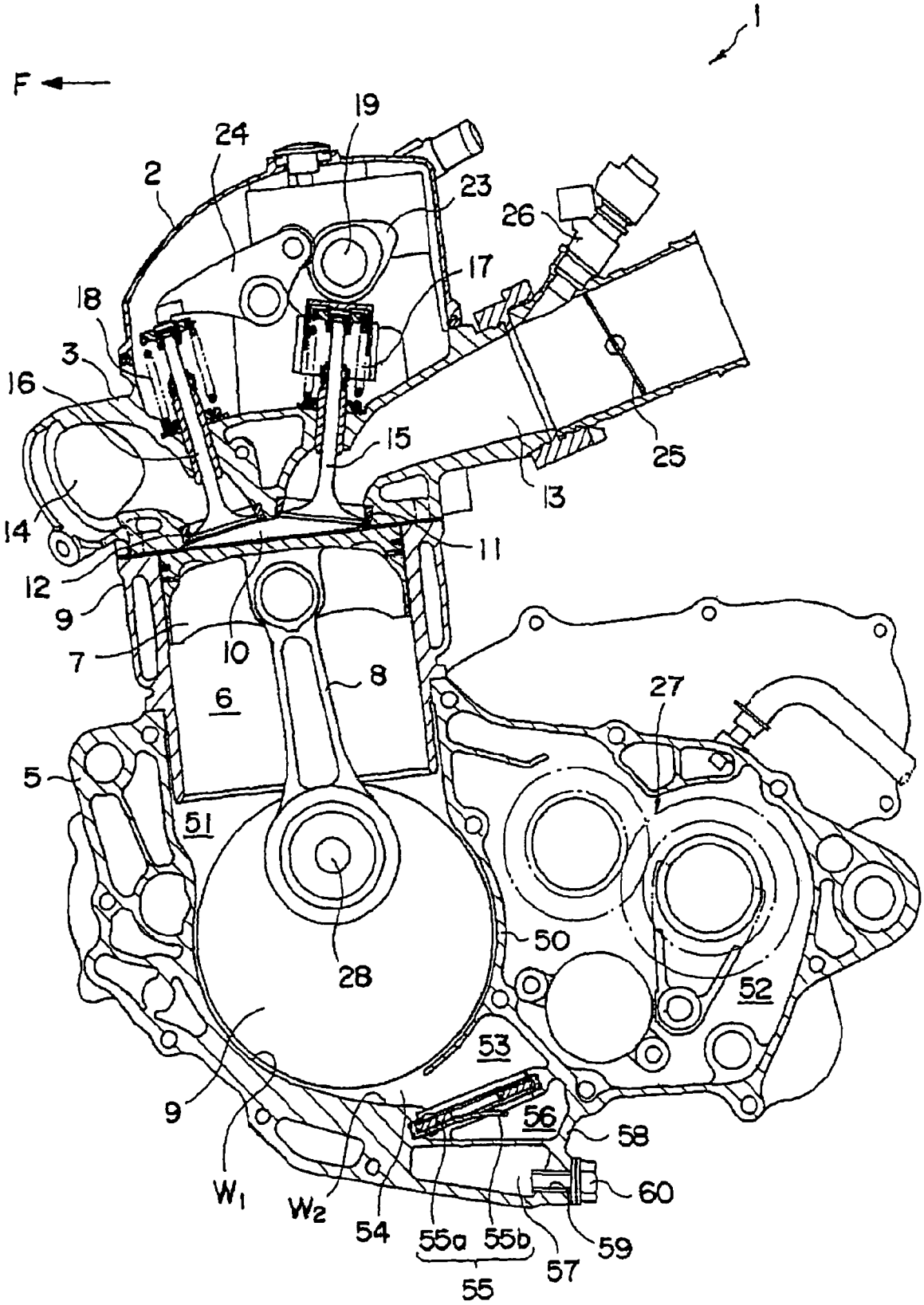
FIG. 1 is a sectional view showing an engine including a crankcase according to the invention viewed from the left side.
Figure 2:
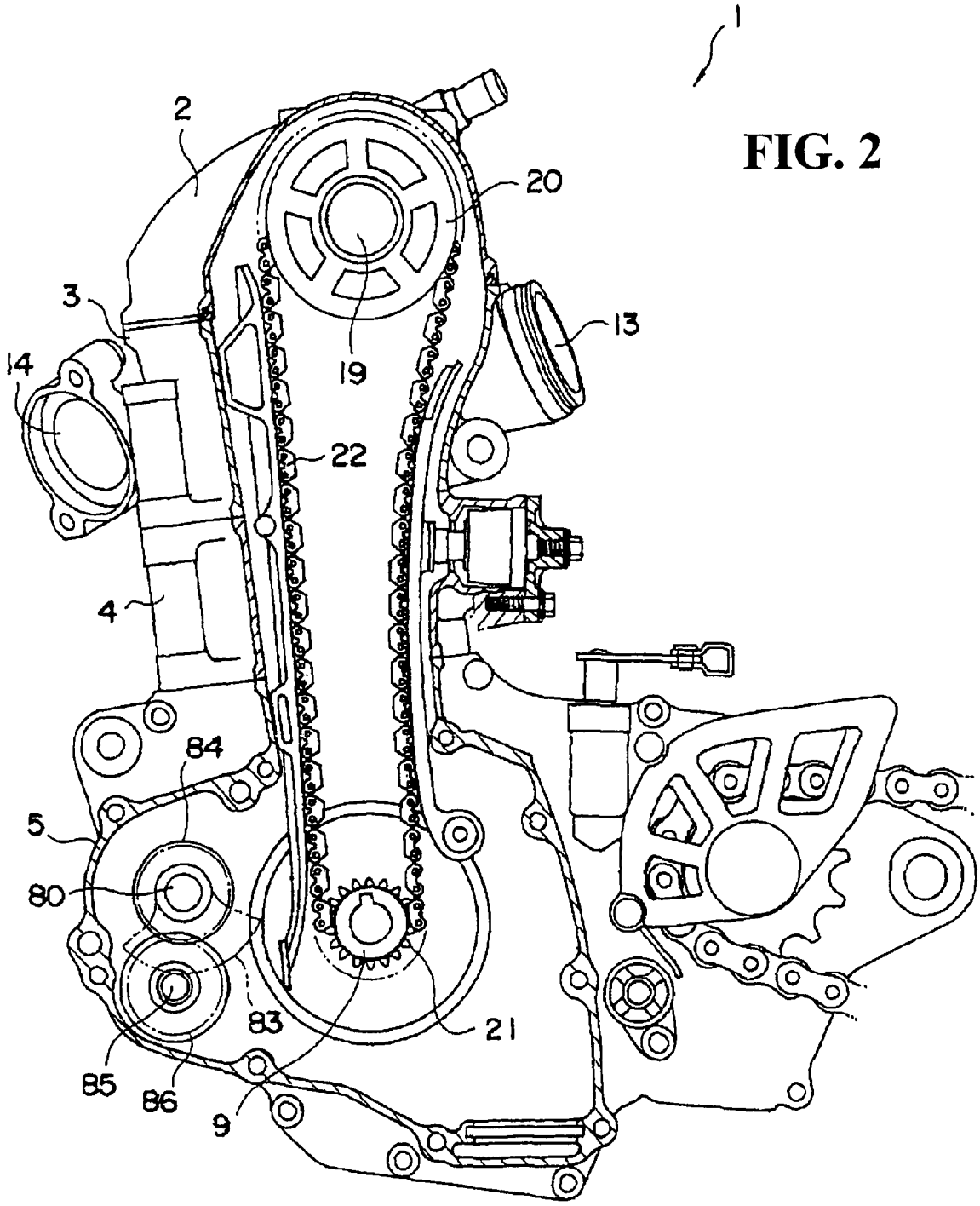
FIG. 2 is a sectional view viewed from the left side for explaining a cam driving mechanism of the engine.
Figure 3:
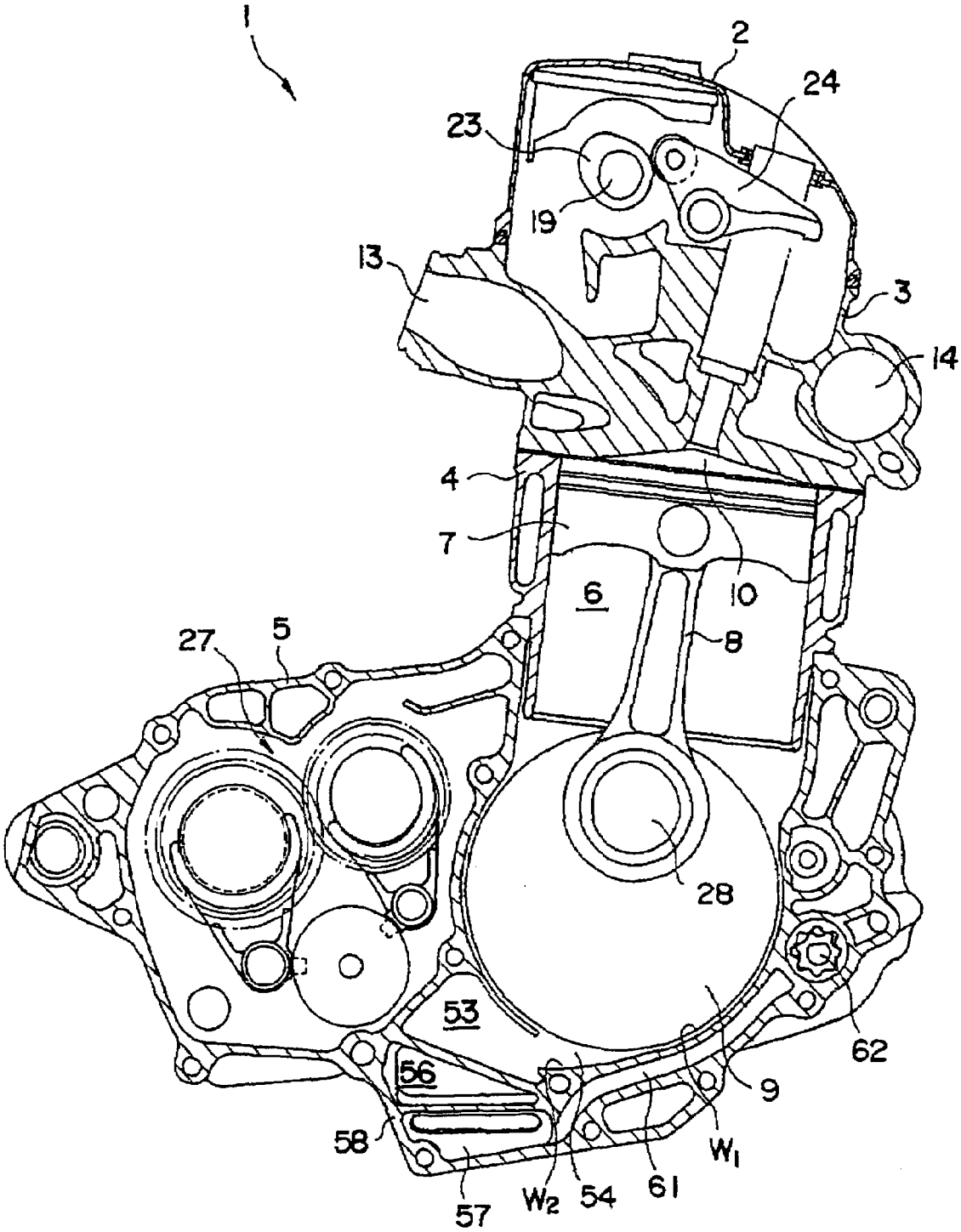
FIG. 3 is a sectional view viewed from the right side for explaining an oil pump of the engine.
Figure 4:
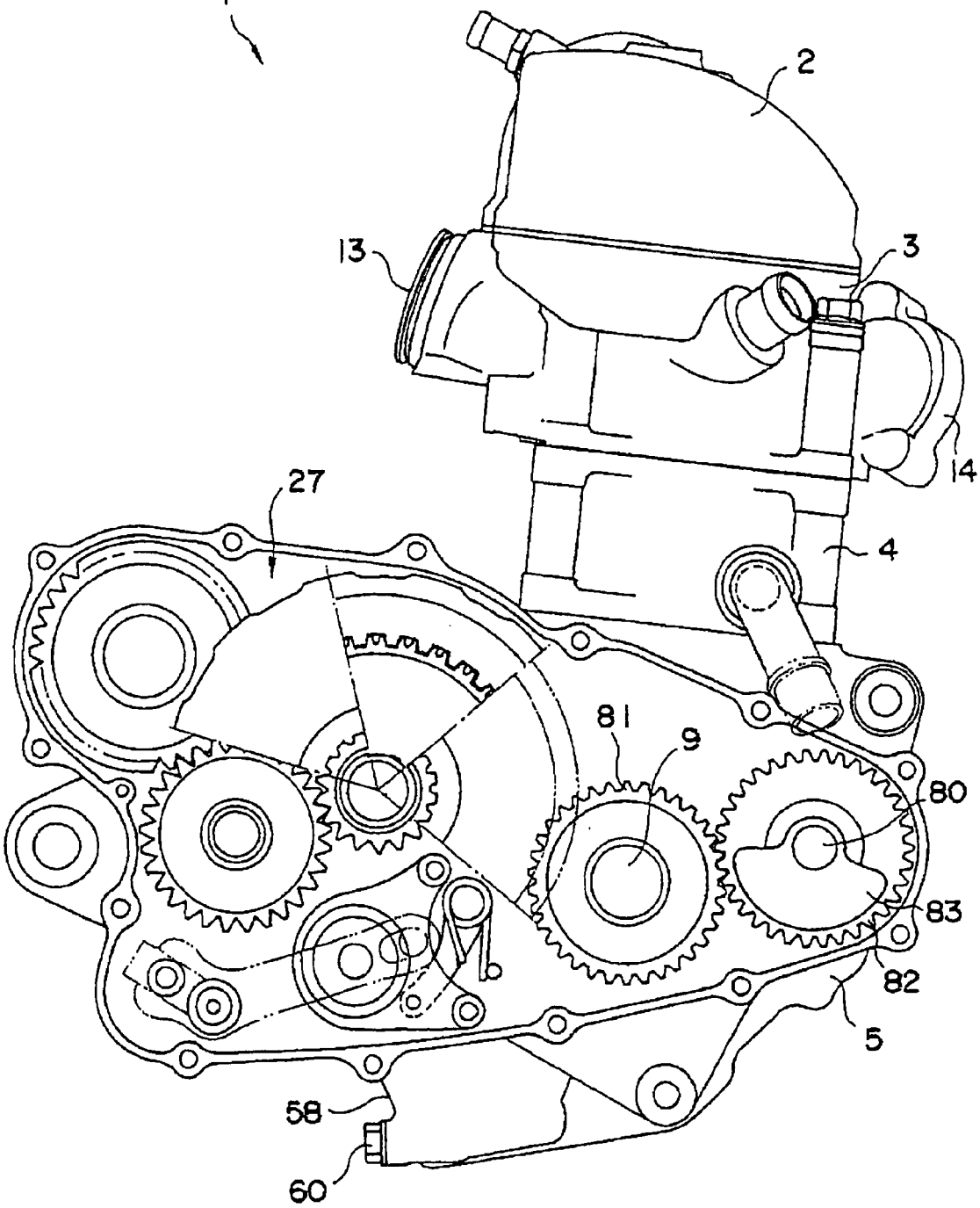
FIG. 4 is a sectional view viewed from the right side for explaining a balance shaft driving mechanism of the engine.
Figure 5:
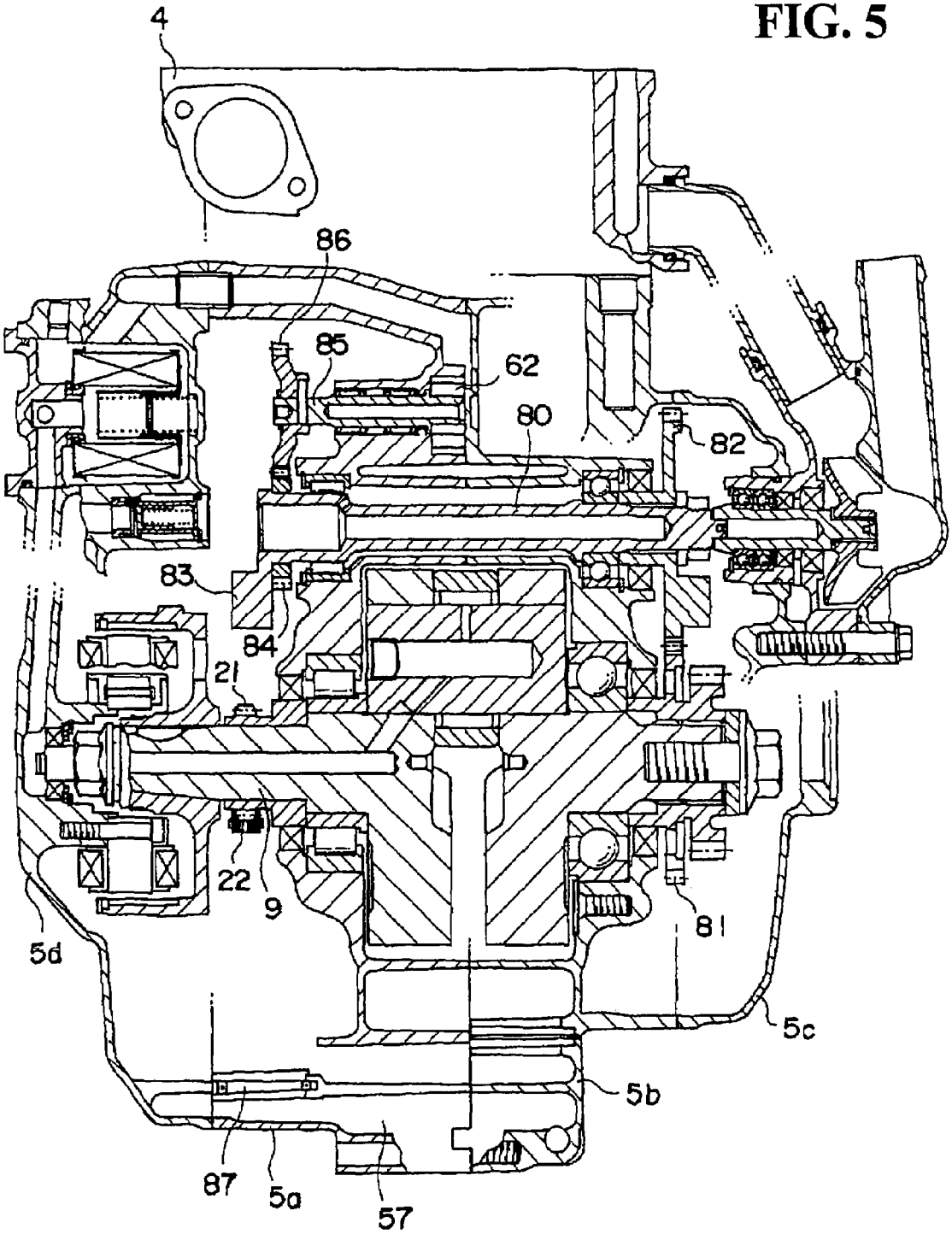
FIG. 5 is a sectional view showing a cylinder block and the crankcase of the engine respectively viewed from the front side.
Figure 6:
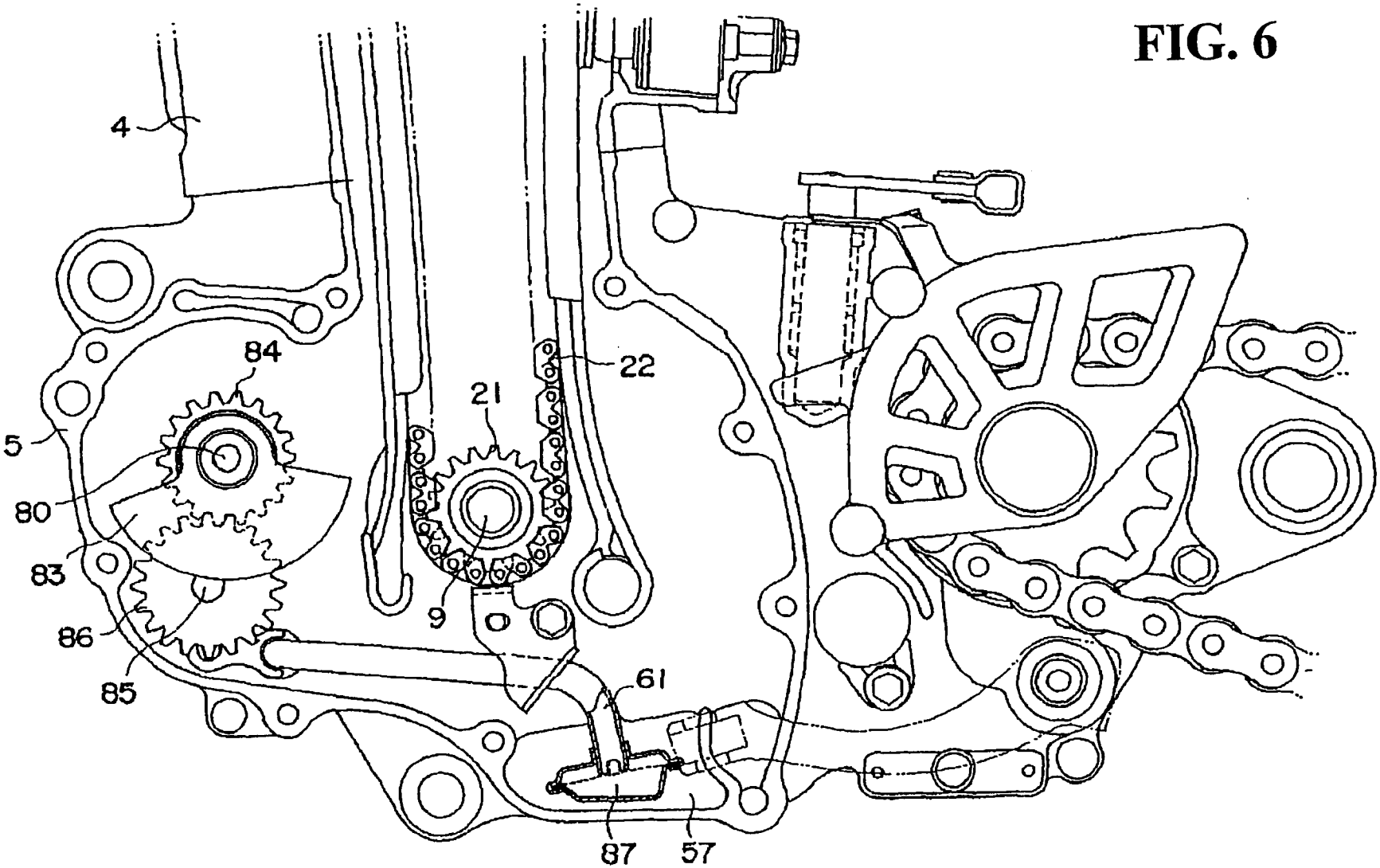
FIG. 6 is a sectional view showing a main part viewed from the left side for explaining the oil pump of the engine.

The present invention will now be described in detail with reference to the accompanying drawings, wherein the same reference numerals will be used to identify the same or similar elements throughout the several views.

Referring to the drawings, a preferred embodiment of the invention will be described below. First, referring to FIG. 1, an engine 1 to which lubrication structure according to an embodiment of the present invention is applied will be described. The engine 1 is used for a motorcycle, particularly for a motorcycle for off-road driving sports. In the following description, an arrow F shown in FIG. 1 points to the front of the motorcycle.

The engine 1 includes a cylinder head cover 2, a cylinder head 3, a cylinder block 4 and a crankcase 5. A cylinder chamber 6 that extends vertically and cylindrically is formed in the cylinder block 4. A piston 7 is arranged in the cylinder chamber 6 so that the piston can be vertically slid and is connected to a crankshaft 9 rotatably held in the crankcase 5 via a connecting rod 8. The connecting rod 8 is connected to the crankshaft 9 by a crankpin 28. An intake port 13 and an exhaust port 14 communicate with a combustion chamber 10 formed by the cylinder chamber 6, the cylinder head 3 and the piston 7 via an inlet 11 and an outlet 12 respectively formed in the cylinder head 3. The respective one ends of an intake poppet valve 15 and an exhaust poppet valve 16 are attached to respective valve stems, are supported by respective retainers, and the respective other ends are pressed in directions in which the inlet 11 and the outlet 12 are ordinarily closed by valve springs 17, 18 supported by the cylinder head 3.

Furthermore, a camshaft 19 for opening and closing the intake valve 15 and the exhaust valve 16 is rotatably supported by the cylinder head 3 and a timing chain 22 is wound on a cam driven sprocket 20 arranged on the camshaft 19 and a cam driving sprocket 21 arranged on the crankshaft 9. Therefore, when the camshaft 19 is rotated in accordance with the rotation of the crankshaft 9 and a cam 23 formed on the camshaft 19 directly pushes down the intake valve 15 or pushes down the exhaust valve 16 via a rocker arm 24, the inlet 11 and the outlet 12 are opened or closed.

A throttle valve 25 and an injector 26 are attached to the intake port 13. The quantity of air cleaned by an air cleaner (not shown) that flows in is regulated by the throttle valve 25. The air is mixed with fuel injected from the injector 26. The air-fuel mixture is supplied to the combustion chamber 10 via the inlet 11 from the intake port 13. After the air-fuel mixture is compressed by the piston 7, it is ignited by an ignition plug (not shown) and is combusted to generate energy for rotating the crankshaft 9 via the piston 7. Afterward, the ignited air-fuel mixture is exhausted outside via the exhaust port 14 from the outlet 12 as exhaust gas.

The inside of the crankcase 5 is separated into a crank chamber 51 storing the crankshaft 9 and a transmission chamber 52 storing a transmission mechanism 27 by a wall 50. The crank chamber 51 is encircled by the front of the crankcase 5 and the wall 50. The upside of the crank chamber 51 is cylindrically open. A lower end of the cylinder block 4 is attached to the crank chamber. The crank chamber 51 and the cylinder chamber 6 are in communication with each other.

A first oil reservoir 53 is formed next to the crank chamber 51 on the downside of the rear side of the crank chamber 51. The first oil reservoir 53 is in communication with the crank chamber 51 via an opening 54 formed between the upside of the front side and the downside of the crank chamber 51. A second oil reservoir 56 is formed via a reed valve 55 on the downside of the rear side of the first oil reservoir 53. Furthermore, a third oil reservoir (an oil pan) 57 in communication with the second oil reservoir 56 is formed on the downside of the second oil reservoir 56 (at the bottom of the crank case 5).

The reed valve 55 diagonally extends from the downside in front to the rear upside in a space that extends vertically, divides the space into the first oil reservoir 53 and the second oil reservoir 56, and extends from the bottom of the first oil reservoir 53 to the upside of the second oil reservoir 56. The reed valve 55 is configured by the body 55*a* of the reed valve which is flat and the substantial center of which is open. A valve element 55*b* like a tongue is attached to the body 55*a* and covers the opening. In this embodiment, the valve element 55*b* is attached to the side of the second oil reservoir 56, a lower end located on the front side is fixed, and the side of an upper end located on the rear side is open downward.

A front side wall W1 surrounding the crank chamber 51 of the crankcase 5 and a lower side wall W2 surrounding the first oil reservoir 53 are continuously formed in the shape of an arc. The valve element 55*b* of the reed valve 55 is arranged on an extended line of the wall W2 extended backward.

Therefore, lubricating oil that lubricates the crankshaft 9 and other things accumulates in the first oil reservoir 53 via a lower part of the crank chamber 51 and the opening 54. When pressure in the crank chamber 51 is increased by the vertical motion of the piston 7, the valve element 55*b* of the reed valve 55 is opened, the lubricating oil is pushed out into the second oil reservoir 56, and further, flows into the third oil reservoir 57. Conversely, as the valve element 55*b* of the reed valve 55 closes even if pressure in the crank chamber 51 decreases, the lubricating oil never flows into the first oil reservoir 53 from the second oil reservoir 56.

In the engine 1, the crankshaft 9 is rotated counterclockwise in FIG. 1 (a crankpin 28 fastened to the crankshaft 9 moves the connecting rod 8 from the upside to the downside through the front side and turns the connecting rod to the upside through the rear side). As shown in FIG. 1, the front side wall W1 is formed when pressure in the crank chamber 51 is increased by the piston 7, that is, along a path that the crankpin 28 is moved from the upside to the downside through the front side and further, the lower side wall W2 is formed along an extended line of the rotational locus of the crankpin 38 (in a direction of a tangent at a lower end of the circumferential rotational locus in a side view). Therefore, the opening 54 is formed on the extended line of the rotational locus, the lubricating oil in the crank chamber 51 flows along the wall W2 from the wall W1 and flows into the first oil reservoir 53. At this time, the reed valve 55 is diagonally arranged as described above and the valve element 55*b* is located on an extended line in a direction in which the lubricating oil flows from the crank chamber 51 into the first oil reservoir 53 (on the extended line of the walls W1 and W2) (that is, the opening 54 and the valve element 55*b* of the reed valve 55 are arranged side by side in the direction of the tangent of the rotational locus). Therefore, the lubricating oil can also smoothly flow into the second oil reservoir 56 by pushing down the valve element 55*b* of the reed valve 55. Further, as the third oil reservoir 57 is formed immediately under the second oil reservoir 56, the lubricating oil in the second oil reservoir 56 also flows into the third oil reservoir 57 soon.

As the lubricating oil hardly accumulates in space before and after the reed valve 55 (in the first oil reservoir 53 and the second oil reservoir 56) when the first to third oil reservoirs 53, 56, 57 and the reed valve 55 are arranged as described above, the lubricating oil in the crank chamber 51 is promptly exhausted and the agitation loss of the lubricating oil by the crankshaft 9 and other things can be reduced. As the reed valve 55 is diagonally arranged, the increase of the entire height of the engine 1 is inhibited, the engine can be compacted, and the oil pan (the third oil reservoir 57) can be arranged under the reed valve 55 in a state in which minimum road clearance is secured.

A balance shaft 80 extended substantially in parallel with the crankshaft 9 is rotatably supported by the crankcase 5 in front of the crankshaft 9. A balancer driven gear 82 engaged with a balancer driving gear 81 arranged on the crankshaft 9 is attached to the side of a right end of the balance shaft 80 and a balancer 83 is formed at the left end. Therefore, as the balance shaft 80 is rotated via the balancer driving gear 81 and the balancer driven gear 82 when the crankshaft 9 is rotated, the balancer 83 is rotated and the vibration of the piston 7 is negated.

An oil pump shaft 85 is rotatably arranged substantially in parallel with the balance shaft 80 on the side of the front end of the crankcase 5 and on the downside of the balance shaft 80. An oil pump driven gear 86 engaged with an oil pump driving gear 84 arranged at the right end of the balance shaft 80 is arranged at the left end of the oil pump shaft 85 and an oil pump 62 is arranged at the right end of the oil pump shaft 85. Therefore, when the crankshaft 9 is rotated and the balance shaft 80 is rotated, the oil pump shaft 85 is rotated via the oil pump driving gear 84 and the oil pump driven gear 85 and the oil pump 62 is operated. The lubricating oil that accumulates in the third oil reservoir 53 is pumped up via an oil passage 61 formed in the crankcase 5 by the oil pump 62 after the lubricating oil is cleaned by a strainer 87 and is utilized for lubricating the inside of the engine 1.

As shown in FIG. 1, the second oil reservoir 56 and the third oil reservoir 57 are protruded on the lower side of the crankcase 5 in the side view. A drain hose 59 pierced longitudinally and connecting the outside and the third oil reservoir (the oil pan) 57 is formed at the lower end of a side wall 58 on the rear side forming the second oil reservoir 56 and the third oil reservoir 57 in the crankcase 5. A drain bolt 60 is ordinarily screwed on the drain hose 59, the drain hose is closed, and the lubricating oil accumulating in the third oil reservoir 57 can be exhausted outside by detaching the drain bolt 60 from the drain hose 59. The drain bolt 60 is protruded in space under the transmission chamber 52.

As described above, when the drain hose 59 is formed on the side wall 58 on the rear side, a part protruded on the lower side of the engine 1 is not required to be provided, minimum road clearance can be secured, and the engine 1 can be compacted. In addition, as the space under the transmission chamber 52 can be utilized by attaching the drain bolt 60 to the rear side of the crankcase 5 (to a face on the rear side of the side wall 58), work for attaching or detaching the drain bolt 60 to/from the drain hose 59 can be also facilitated.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A lubrication structure of an engine, comprising:

a crankcase provided with a crank chamber that houses a crankshaft;

a first oil reservoir in communication with the crank chamber and formed adjacent a bottom of the crank chamber;

a second oil reservoir in communication with the first oil reservoir and formed adjacent a side of and on a bottom of the first oil reservoir;

a third oil reservoir in communication with the second oil reservoir and formed adjacent a bottom of the second oil reservoir; and a reed valve extending diagonally from the bottom of the first oil reservoir toward the top of the second oil reservoir in a part where the first oil reservoir and the second oil reservoir communicate with the crankcase, said reed valve being provided with a valve element that opens and closes according to a variation of pressure in the crank chamber, wherein the valve element of the reed valve is arranged on the side of the second oil reservoir.

2. The lubrication structure of the engine according to claim 1, wherein a part where the crank chamber and the first oil reservoir communicate and the valve element of the reed valve are arranged side by side in a tangential direction of a rotational locus of the crankshaft in a side view.

3. The lubrication structure of the engine according to claim 2, wherein a wall forming the crank chamber and a wall forming the first oil reservoir are continuously formed, and the valve element is arranged on an extended line of the walls.

4. The lubrication structure of the engine according to claim 1, wherein a wall forming the crank chamber and a wall forming the first oil reservoir are continuously formed, and the valve element is arranged on an extended line of the walls.

5. The lubrication structure of the engine according to claim 1, wherein the reed valve extends diagonally upward to form a bottom of the first oil reservoir and a top of the second oil reservoir such that reed valve separates the first oil reservoir from the second oil reservoir.

6. The lubrication structure of the engine according to claim 1, wherein the third oil reservoir is an oil pan that includes a drain hole formed through a wall thereof, the drain hole including a drain bolt threaded therein.

7. The lubrication structure of the engine according to claim 1, wherein a lower end of the valve element is fixed to a body of the reed valve and an upper end of the valve element opens toward the second oil reservoir.

8. The lubrication structure of the engine according to claim 1, wherein a body of the reed valve is flat and a substantial center of the body of the reed valve has an opening formed therethrough, and the valve element is a tongue shaped element that is attached to the body of the reed valve to cover the opening.

9. The lubrication structure of the engine according to claim 8, wherein a lower end of the valve element is fixed to the body of the reed valve and an upper end of the valve element opens toward the second oil reservoir.

10. A lubrication structure of an engine, comprising:

a crank chamber;

a first oil reservoir in communication with the crank chamber and formed adjacent a bottom of the crank chamber;

a second oil reservoir in communication with the first oil reservoir and formed adjacent a bottom of the first oil reservoir; and a reed valve extending diagonally between the first oil reservoir and the second oil reservoir, said reed valve being provided with a valve element that opens and closes according to a variation of pressure in the crank chamber, wherein the valve element of the reed valve is arranged to open toward the second oil reservoir.

11. The lubrication structure of the engine according to claim 10, wherein the valve element of the reed valve is arranged on a tangent of the crank chamber.

12. The lubrication structure of the engine according to claim 11, wherein a wall forming the crank chamber and a wall forming the first oil reservoir are continuously formed, and the valve element is arranged on an extended line of the walls.

13. The lubrication structure of the engine according to claim 10, wherein a wall forming the crank chamber and a wall forming the first oil reservoir are continuously formed, and the valve element is arranged on an extended line of the walls.

14. The lubrication structure of the engine according to claim 10, wherein the reed valve extends diagonally upward to form a bottom of the first oil reservoir and a top of the second oil reservoir such that reed valve separates the first oil reservoir from the second oil reservoir.

15. The lubrication structure of the engine according to claim 10, further comprising a third oil reservoir in communication with the second oil reservoir, wherein the third oil reservoir is an oil pan that includes a drain hole formed through a wall thereof, the drain hole including a drain bolt threaded therein.

16. The lubrication structure of the engine according to claim 10, wherein a lower end of the valve element is fixed to a body of the reed valve and an upper end of the valve element opens toward the second oil reservoir.

17. The lubrication structure of the engine according to claim 10, wherein a body of the reed valve is flat and a substantial center of the body of the reed valve has an opening formed therethrough, and the valve element is a tongue shaped element that is attached to the body of the reed valve to cover the opening.

18. The lubrication structure of the engine according to claim 17, wherein a lower end of the valve element is fixed to the body of the reed valve and an upper end of the valve element opens toward the second oil reservoir.

* * * * *